United States Patent [19]

Abney et al.

[11] 3,960,366

[45] June 1, 1976

[54] REVERSE ACTING LOCK OPEN CROSSOVER VALVE

[75] Inventors: Dave L. Abney; Robert C. Williams, both of Dallas, Tex.; Horace E. Gilbert, Gretna, La.

[73] Assignee: Dresser Industries, Inc., Dallas, Tex.

[22] Filed: Mar. 18, 1974

[21] Appl. No.: 452,233

Related U.S. Application Data

[62] Division of Ser. No. 194,228, Nov. 1, 1971, Pat. No. 3,818,986.

[52] U.S. Cl. ..... 251/341; 166/226; 166/51

[51] Int. Cl.[2] ..... E21B 43/04

[58] Field of Search ..... 251/341, 347, 343, 344, 251/345, 346, 100, 95; 166/224 A, 226, 278, 51, 131, 226, 143, 184

[56] References Cited

UNITED STATES PATENTS

| | | | |
|---|---|---|---|
| 2,059,631 | 11/1936 | Erwin | 166/145 |
| 2,569,437 | 10/1951 | Baker | 251/341 X |
| 2,649,916 | 8/1953 | Brown | 166/145 |
| 2,738,012 | 3/1956 | Springer | 166/146 |
| 2,822,874 | 2/1958 | Brown | 166/226 X |
| 2,874,927 | 2/1959 | Conrad | 251/100 |
| 3,126,963 | 3/1964 | Graham | 166/51 |
| 3,153,451 | 10/1964 | Chancellor et al. | 166/51 |
| 3,182,726 | 5/1965 | Stone, Jr. | 166/147 X |
| 3,190,360 | 6/1965 | Farley | 166/226 |
| 3,211,230 | 10/1965 | Stone, Jr. | 166/147 X |
| 3,627,046 | 12/1971 | Miller | 166/278 |
| 3,412,805 | 11/1968 | Gibbin et al. | 166/226 X |
| 3,636,696 | 1/1968 | Berryman | 166/226 |
| 3,710,862 | 1/1973 | Young | 166/51 X |

*Primary Examiner*—Alan Cohan
*Assistant Examiner*—Robert J. Miller
*Attorney, Agent, or Firm*—William E. Johnson, Jr.; Michael J. Caddell

[57] ABSTRACT

The apparatus and method provides the ability to selectively treat a producing zone in a well and to gravel pack an annulus in the well casing outside a screen type liner pipe. A tubing string extending from the surface of the well bore is connected to a packer by a crossover valve. Flow down the tubing string is directed to an annulus below the packer, then inwardly through the screen type liner, then upward through the crossover into the annulus above the packer and then to the earth's surface. Communication from the crossover to the annulus above the packer may be selectively closed to permit a treating pressure to be exerted down the tubing to force a treating fluid into the producing zone. The treating pressure is isolated from the casing above the packer to protect the casing above the packer.

1 Claim, 8 Drawing Figures

REVERSE ACTING LOCK OPEN CROSSOVER VALVE

This is a division of application Ser. No. 194,228 filed Nov. 1, 1971 now Pat. No. 3,818,986.

BACKGROUND OF THE INVENTION

The field of the invention relates to treating and gravel packing oil and gas and other types of wells. Some producing wells contain producing zones that have loose sand. Flow of the desired liquid or gas from such zones into the well bore often carries undesirable amounts of sand which can cause erosion of the equipment and can cause plugging of the flow passages. It has been found that provision of a screen pipe within the perforated producig zone with suitable small size holes or slots provided in the screen pipe and having the annulus between the screen pipe and the casing filled with a suitable size gravel of a predetermined screen size allows passage of the desired fluids from the producing zone and prevents passage of the same. Producing zones also sometimes require treatment in order to increase the area of flow passages to the well bore to permit greater drainage of the producing zone into the well bore. It is sometimes desired to treat a producing zone with acid or another fluid to increase the productivity of the zone.

The prior art includes crossover arrangements whereby gravel can be pumped into an annulus between a screen pipe and the casing by providing a crossover flow arrangement communicating a tubing string to an annulus below a packer outside a screen pipe and providing a return passage through the packer communicating with the annulus outside the tubing above the packer. The prior art in treating producing zones with acid or other fluids includes a simple or heavy duty packer connected to a tubing string allowing the treating fluid to be pumped to an area adjacent the producing zone, allowing displaced fluid to return around an unset packer or through an open valve in the tubing string providing communication between the tubing and the casing above the packer. However, it has heretofore been unknown in the art to provide a single apparatus selectively capable of performing both functions.

It is therefore an object of this invention to provide an apparatus for selectively treating and gravel packing a well.

It is a further object of this invention to provide apparatus and method for gravel packing and treating a well without removing the tubing between the treating and gravel packing operations.

It is a still furher object of this invention to provide apparatus and method for acidizing and gravel packing a producing zone in a well.

It is a still further object of this invention to provide completely retrievable apparatus for treating and gravel packing a producing zone in a well.

It is a still further object of this invention to provide a selectively operable apparatus for treating and gravel packing a well without imposing the pressure required for treating the zone on the casing above the packer.

SUMMARY OF THE INVENTION

These and other objects of the invention are achieved by methods and apparatus for use in a well casing in a well bore including a packer anchored in the well casing and a tubing string extending from the surface of the well bore through the packer, wherein an upper portion of the tubing forms an upper annulus and a lower portion of the tubing below the packer forms a lower annulus, including a screen pipe connected to and communicating the lower tubing string portion to the lower annulus, and a crossover valve arrangement for communicating the upper tubing string portion to the lower annulus and for selectively communicating the lower tubing string portion to the upper annulus and for selectively preventing communication between the lower tubing string portion and the upper annulus.

DESCRIPTION OF THE PREFERRED EMBODIMENT

Figure 1:
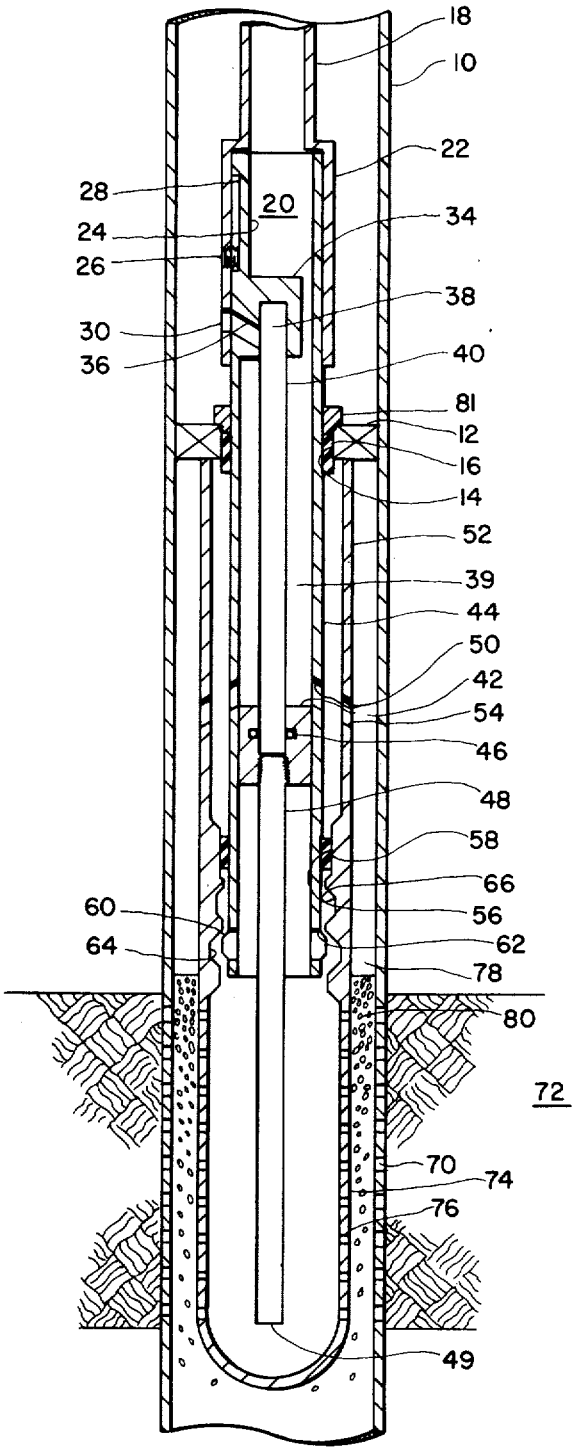
FIG. 1 is a schematic illustration, partially in elevation and partially in section, showing an apparatus according to this invention.

Referring to FIG. 1, a well bore is illustrated with a well casing 10 in place. A packer 12 having a seal bore 14 is anchored in sealing engagement with the casing 10. A tubing string 18 extends from the surface of the well bore and is in engagement with a crossover valve assembly shown generally at 20. A seal nipple 16 is located in sealing engagement with seal bore 14 by shoulder 81. The crossover valve 20, the shoulder 81, a seal nipple 16 and a lower portion 44 of tubing string 18, a seal nipple 58 and a collet 60 are threadedly connected into an assembly. The crossover valve assembly has a housing 22 connected to the tubing string 18. A mandrel 24 is disposed in a rotatable and slidable relation to the housing 22. The axial movement and rotation of the housing 22 on mandrel 24 is controlled by a jay-pin 26 threadedly engaged to housing 22 and cooperating with jay-slot 28 formed in the outside of mandrel 24. The crossover valve is ilustrated in the open position communicating a port 30 in the housing with passage 36 in the mandrel. A crossover 34 is disposed in sealing engagement with mandrel 24 and having passages 36 and 38 communicating with port 30. An inner tubing string 40 is connected with passage 38 in crossover 34 and extends to a barrier 42 in a lower portion 44 of tubing string 18. A suitable seal 46 seals the lower end of tubing string 40 to a lower portion 44 of the tubing string 18. A tubular extension or tubing string 48 is attached to the barrier 42 to extend the passageway in tubing string 40, the lower end of tubing string 48 having a bottom opening 49 to allow fluid communication between screen pipe 74 and the tubing string 48. The lower portion 44 of tubing string 18 has at last one port 50 above the barrier 42. A tubing string 52 is suspended below packer 12. At least one port 54 in the tubing string 52 is in communication with the ports 50 in the tubing string lower portion 44. A seal bore 56 is provided inside the tubing string 52. The seal nipple or seal assembly 58 is provided in sealing engagement with the seal bore 56. The collet 60 is a tubular member with axial slots 62 and is provided with an enlarged portion engaging a groove 64 in the tubing string 52. The collet 60 is a heat treated spring member which is deformable to expand into engagement with the groove 64 and deformable to a smaller diameter upon upward axial thrust to engage groove 66. The tubing string 18 may be located at a position upward from that shown in FIG. 1 so that the collet 60 can engage a groove 66 which is positioned to locate the seal nipple 16 above the seal bore 14 in the packer 12. The casing is provided with a multiplicity of perforations 70 to communicate with a producing zone 72 to allow oil and/or gas production to flow into the casing 10. The tubing string 52 is provided with a screen pipe 74 which has a multiplicity of small holes or slots 76. A lower annulus 78 is formed between the casing 10, the tubing string 52 and the screen pipe 74.

This apparatus provides the ability to place into the lower annulus 78 particles of rock called gravel 80 which is of a selected screen size large enough to be retained by holes or slots 76 and to allow passage of the oil and gas from producing zone 72 through perforations 70 and slots 76 but prevent the flow of sand from the producing zone 72. The shoulder 81 is connected to the mandrel 24 to locate the seal nipple 16 in seal bore 14 and to position tubing string 18 in proper place in the well bore.

Figure 2:
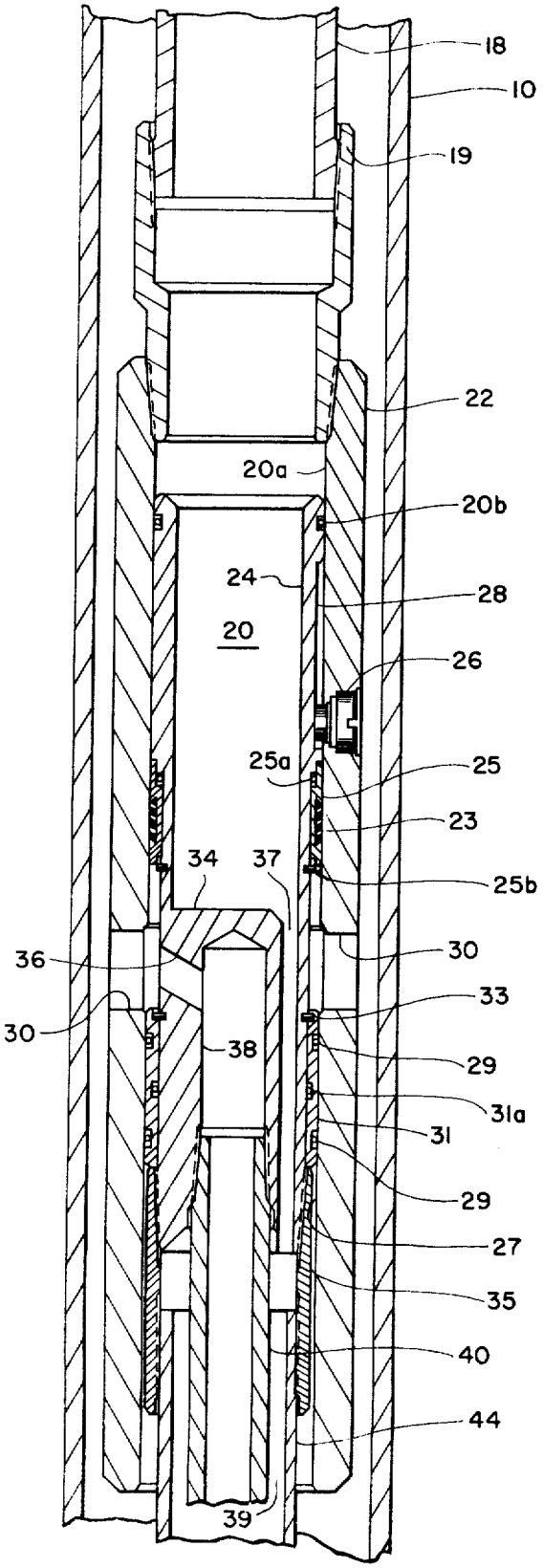
FIG. 2 is an enlarged view of a portion of the apparatus as illustrated in FIG. 1.

Referring now to FIG. 2, the tubing string 18 is illustrated connected to a threaded adapter 19 which is threadedly engaged to housing 22. Housing 22 has an upper seal bore 20*a*. A seal ring 20b which may be of the O-ring type is positioned in sealing engagement between the mandrel 24 and seal bore 20a. A second seal 23 is molded and bonded into a metal sleeve 25 which is sealed to mandrel 24 by seal 25*a* which may be of the O-ring type. A retaining ring 25*b* holds the seal 23, sleeve 25 and seal 25*a* in place. At least one port 30 is provided in the wall of housing 22. A seal bore 27 is provided in the lower end of housing 22. At least one seal 29 and preferably two seals 29 as illustrated are provided in sealing engagement with seal bore 27 and a sleeve 31 which is in encircling relationship with mandrel 24. A seal 31a which may be of the O-ring type seals between mandrel 24 and sleeve 31. Sleeve 31 is held in position on mandrel 24 by retaining ring 33 positioned in a groove on mandrel 24 and by coupling 35 which is threadedly engaged to mandrel 24.

In the position of the crossover valve shown in FIG. 2, port 30 in housing 22 is in communication with passage 36 and crossover 34. Passage 38 in crossover 34 provides communication to tubing string 40 which is threadedly engaged with the lower portion of crossover 34. Crossover 34 forms an integral portion of mandrel 24 and provides passageway 37 through mandrel 24 and provides communication from tubing string 18 above crossover valve 20 with the annular passage 39 formed between the lower portion 44 of tubing string 18 which is threadedly engaged with coupling 35 and between tubing string 40.

Relative movement of mandrel 24 within housing 22 is controlled by jay-pin 26 which is threadedly engaged in the wall of housing 22 and is movable in jay-slot 28 to lock the mandrel and housing in one axial position and allow movement to another axial position as hereinafter described.

Figure 3:
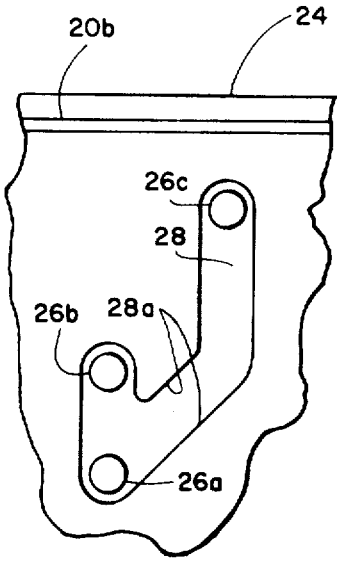
FIG. 3 is an elevation showing the jay-slot on the mandrel of FIG. 2.

FIG. 3 is an exterior view of the mandrel 24 showing the jay-slot 28 and O-ring seal 20*b*. Jay-pin 26 is illustrated in position 26a as shown in FIG. 2. The valve 20 may be held in the open position shown while the jay-pin is in the position illustrated by circle 26a and by circle 26*b* and positions intermediate 26a and 26b. By moving jay-pin to position 26a and then simultaneously rotating the housing 22 and axially moving the housing 22 upward on the mandrel 24, the jay-pin may be moved upwardly and to the right as shown in FIG. 3 and moved through an angular portion 28*a* of jay-slot 28 and upon continued axial movement may be moved relative to mandrel 24 until the jay-pin 26 is in position 26c to move the crossover valve assembly 20 to the closed position shown in FIG. 4.

Figure 4:
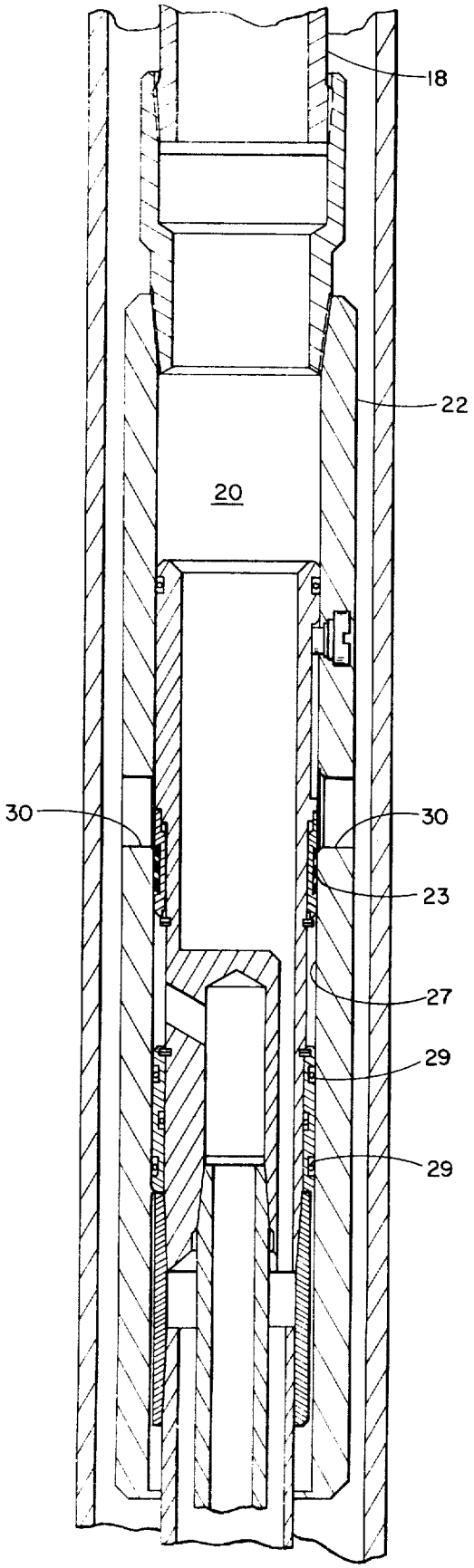
FIG. 4 is a view, partially in elevation and partially in section, of the crossover valve of FIG. 2 shown in the closed position.

Referring now to FIG. 4, the axial movement lifting the tubing string 18 upwardly to position the jay-pin 26 in position 26c as illustrated in FIG. 3 will move the housing 22 upwardly to position seal 23, and seals 29 in sealing engagement with seal bore 27. Since the passage 36 is located intermediate seals 23 and 29, communication from passage 36 to port 30 is prevented while the valve is in the extended position illustrated in FIG. 4.

OPERATION OF THE PREFERRED EMBODIMENT

The packer 12 is anchored, in accordance with various methods well known in the art, in sealing engagement with the casing 10 at the desired proper depth, suspending the tubing string 52 so that screen pipe 74 has the slots or holes 76 at approximately the same depth as the perforations 70 in the casing 10. The tubing 48, the lower portion of the tubing 44 and the barrier 42 and the seal nipple 16, the locator 81, the crossover valve 20 and the tubing string 40 are all lowered into position on tubing string 18. The seal nipple 16 is positioned in sealing engagement with seal bore 14 in packer 12. The crossover valve 20 is lowered into the well in the open position with ports 30 in communication with passage 36, passage 38 and tubing string 40.

In treating the producing zone with acid, the desired amount of acid is pumped into the tubing string followed by a sufficient quantity of water, mud or other fluid to position the acid in proximity to the producing zone 72. Flow is established down inside the tubing string 18, down through passage 37 (in FIG. 2) in valve 20, down through annular passage 39, and out through ports 50 and 54 into the lower annulus 78 into proximity with zone 72. The already existing well bore fluid, ahead of the acid or the treating fluid, is displaced ahead of the acid and enters the slots 76 in the screen pipe 74 and flows into the bottom opening 49 of tubing string 48 and up through tubing string 40 through passages 38 and 36 and port 30 into the upper annulus in the casing 10 external of the tubing 18 above the packer 12 where such fluid is conducted to the surface of the well bore. When the acid or other treating fluid is positioned in proximity to the producing zone, by known methods such as counting pump stokes, the tubing string 18 is lowered so that the jay-pin 26 moves to position 26a in the jay-slot 28 as illustrated in FIG. 3. Then a slight left-hand rotation of the tubing 18 while picking up the tubing string will move the jay-pin 26 to position 26c and close the crossover valve 20 as illustrated in FIG. 4. Pressure is then applied down the tubing string 18 to force the treating fluid, for example, acid, into the producing zone 72. The pressure required to force the fluid into the producing zone is imposed through the slots 76 in the scree pipe 74 and into the tubing string 48, the tubing string 40, the passage 38 and the passage 36. Communication to the annulus above the packer is prevented by the seals 23 and 29 in engagement with the seal bore 27 in the valve.

It is desirable to avoid imposing a treating pressure on a casing string above the producing zone because the casing commonly has less pressure capability than a tubing string. Also since the casing is permanently installed in the well, erosion and corrosion may significantly reduce the pressure capability of the casing during the life of the well. Therefore, a casing string might rupture if a treating pressure were imposed against the inside of the casing.

Once the treating fluid has been pumped into the producing zone, the crossover valve may be opened by lowering tubing string 18 to its lowermost position in the well casing positioning jay-pin 26 in position **26*a* or 26*b* as illustrated in FIG. 3. The angular portion of jay-slot 28 will guide jay-pin 26 from position 26c to position 26*a* upon axial movement of the housing 22 on the mandrel 24. Communication is then established between the crossover passage 38, passage 36 and housing port 30 communicating the producing zone with the annulus above the packer. A mixture of gravel and fluid such as water may then be pumped down the tubing. The mixture will flow down through passage 37, through annular passage 39 and out the ports 50 and 54 into the lower annulus 78 outside the tubing string 52 below the packer. The fluid will pass through slots 76 in the screen pipe but the gravel will be of a predetermined size large enough that the gravel particles will not pass through the screen pipe and the gravel will be deposited in the annulus between screen pipe 74 and casing 10 adjacent the producing zone. The fluid with which the gravel was pumped into position will pass on through slots 76 in the screen pipe and up through the tubing string 48 and the tubing string 40 through the passages 38 and 36 through the port 30** into the upper annulus where fluid is returned to the surface of the well bore.

As an optional feature of the invention, after the gravel is placed, the tubing may be lifted to disengage the seal nipple 16 from the seal bore 14 and be lifted sufficiently to engage the collet 60 with groove 66 with valve 20 in the open position. Fluid may then be pumped down the casing annulus to pass down through seal bore 14 down through the annulus between the lower portion 44 of the tubing string and the tubing string 52 and pass into the tubing string 44 through the port 50 where flow can proceed upward through passage 37 and upward to the surface of the well through tubing string 18. Debris in the upper annulus of the casing and on top of packer 12 may thereby be entrained by the fluid and displaced upwardly through the tubing string 18 to the surface of the well bore.

DESCRIPTION OF THE ALTERNATE EMBODIMENTS

Figure 5:
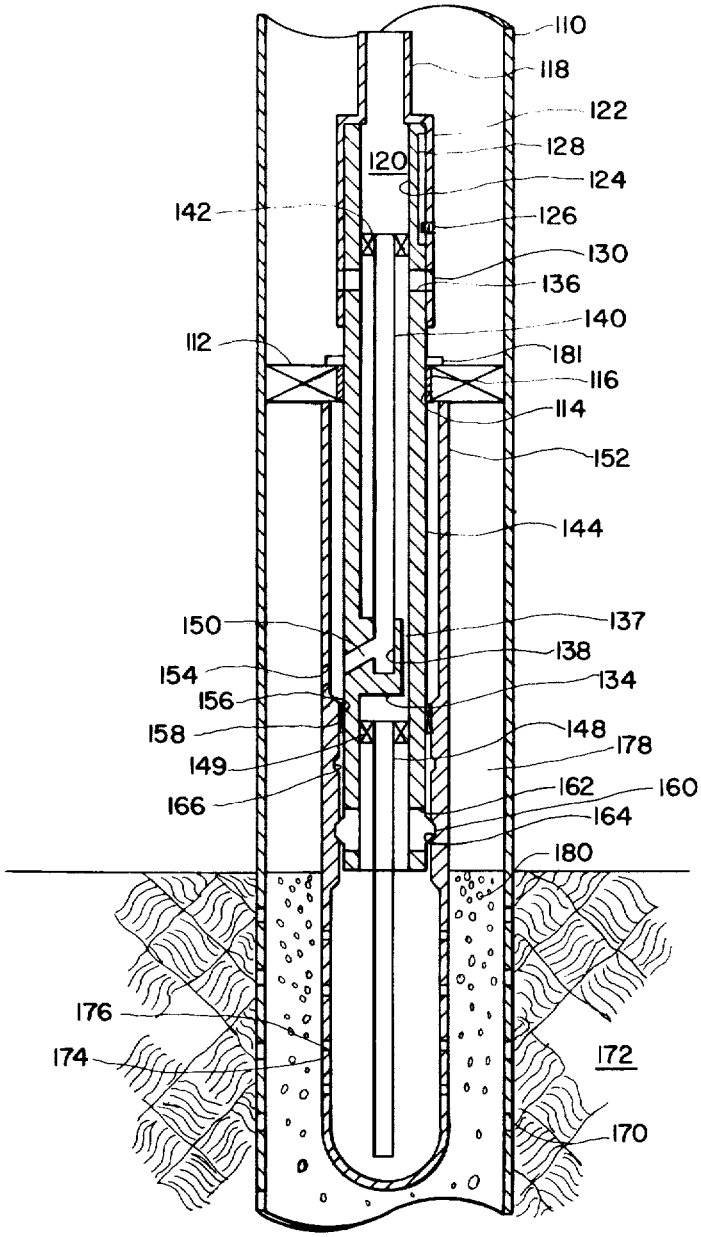
FIG. 5 is a schematic view, partially in elevation and partially in section, illustrating an alternate embodiment according to this invention.

Referring to FIG. 5, a well bore is illustrated with a well casing 110 intersecting a producing zone 172. A packer 112 having a seal bore 114 is anchored in sealing engagement with the casing 110. A tubing string 118 extends from the surface of the well bore and is in engagement with a crossover valve assembly shown generally at 120. A seal nipple 116 is located in sealing engagement with seal bore 114 by a shoulder 181. The crossover valve 120, the shoulder 181, a seal nipple 116 and a lower portion 144 of tubing string 118, a seal nipple 158 and a collet 160 are threadedly connected into an assembly. The crossover valve assembly has a housing 122 connected to the tubing string 118. A mandrel 124 is disposed in a rotatable and slidable relation to the housing 122. The axial movement and rotation of the housing 122 on mandrel 124 is controlled by a jay-pin 126 threadedly engaged to housing 122 and cooperating with jay-slot 128 formed in the outside of mandrel 124. The crossover valve is illustrated in the open position communicating a port 130 in the housing with port 136 in the mandrel.

In the position shown in FIG. 5, housing ports 130 are in communication with ports 136 in the wall of mandrel 124. A barrier 142 is positioned in sealing engagement in mandrel 124 above mandrel ports 136. An inner tubing string 140 is sealingly engaged to barrier 142. Tubing string 144 extends below crossover valve 120. The shoulder 181 is provided on the lower tubing string 144 to locate the tubing with respect to the packer 112 and to locate seal nipple or seal assembly 116 in seal bore 114 in packer 112. Crossover 134 is positioned inside lower string 144 and provides a port 136 which communicates with port 154 in lower tubing string 152 which is suspended below packer 112. Tubing string 140 extends to and seals in crossover 134 and communicates with passage 138 in crossover 134. An inner tubing string 140 is connected with passage 138 in crossover 134 and extends to a barrier 142 in the mandrel 124. A tubular extension 148 may be attached to a barrier 149 to extend communication to the passageway 137. The lower portion 144 of tubing string 118 has at least one passage 150 in the crossover 134. A tubing string 152 is suspended below packer 112. At least one port 154 in tubing string 152 is in communication with the passage 150. A seal bore 156 is provided inside the tubing string 152. The seal nipple or seal assembly 158 is provided in sealing engagement with the seal bore 156. The collet 160 is a tubular member with axial slots 162 and is provided with an enlarged portion engaging a groove 164 in the tubing string 152. The collet 160 is a heat treated spring member which is deformable to expand into engagement with the groove 164 and deformable to a smaller diameter upon upward axial thrust to engage groove 166. The tubing string 118 may be located at a position upward from that shown in FIG. 1 so that the collet 160 can engage a groove 166 which is positioned to locate the seal nipple 116 above the seal bore 114 in the packer 112. The casing 110 is provided with a multiplicity of perforations 170 to communicate with the producing zone 172 to allow oil and/or gas production to flow into the casing 110. The tubing string 152 is provided with a screen pipe 174 which has a multiplicity of small holes or slots 176. A lower annulus 178 is formed between the casing 110, and the tubing string 152 and the screen pipe 174.

This apparatus provides the ability to place into the lower annulus 178 particles of rock called gravel 180 which is of a selected screen size large enough to be retained by the holes or slots 176 and to allow passage of the oil and gas from producing zone 172 through perforations 170 and slots 176 but prevent the flow of sand from the producing zone 172. The shoulder 181 is connected to the mandrel 124 to locate the seal nipple 116 in seal bore 114 and to position tubing string 118 in proper place in the well bore. The valve 120 has the jay-pin 126 and jay-slot 128 arranged in like manner to the preferred embodiment to control relative movement of the housing 122 on mandrel 124, to communicate at least one mandrel port 136 to at least one housing port 130 when the housing 122 and mandrel are in one axial position and to prevent communication between the ports 130 and 136 when the valve is in another axial position.

The valve 120, the crossover 134, the barrier 142, the tubing string 140 and the associated parts serve to communicate the tubing string 118 to the lower annulus 178 and to selectively communicate and prevent communication from the lower tubing string 148 to the upper annulus above the packer 112.

Figure 6B:
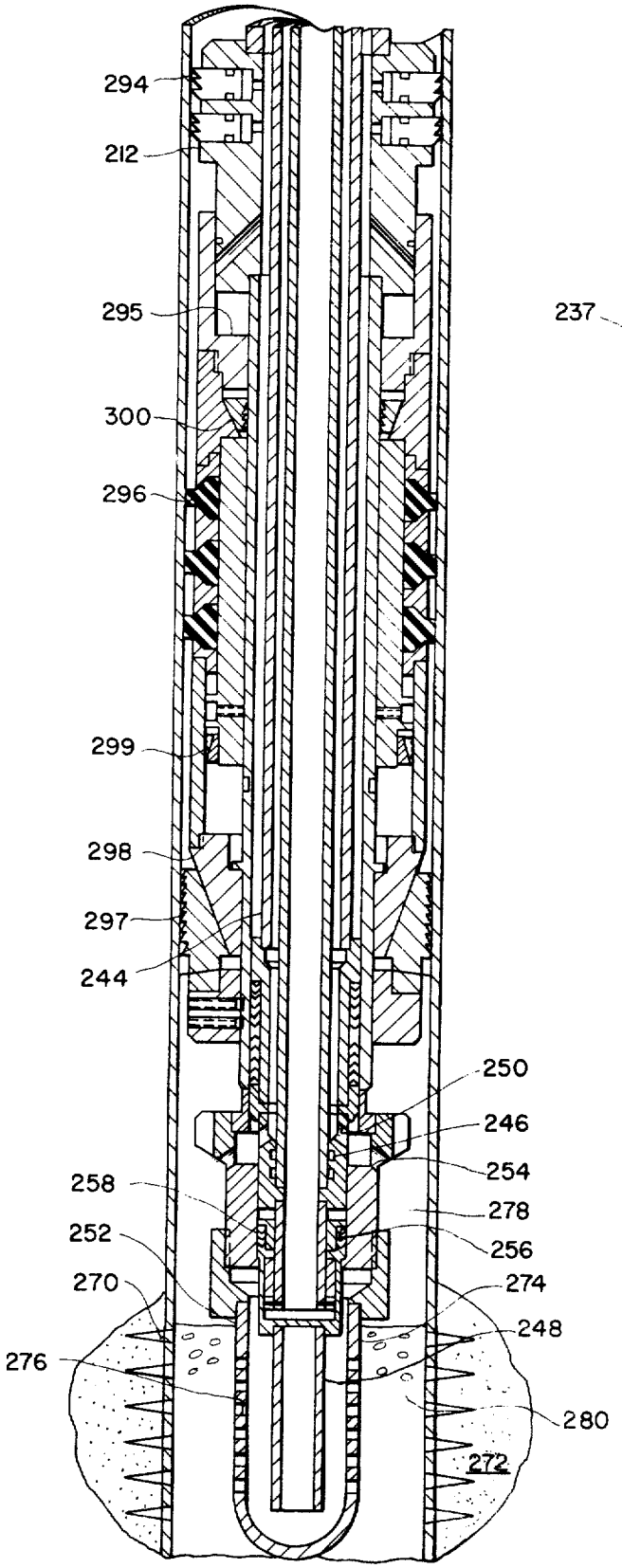
FIGS. 6A and 6B illustrate a schematic view of a well completion with still another alternate embodiment according to this invention.
Figure 6A:
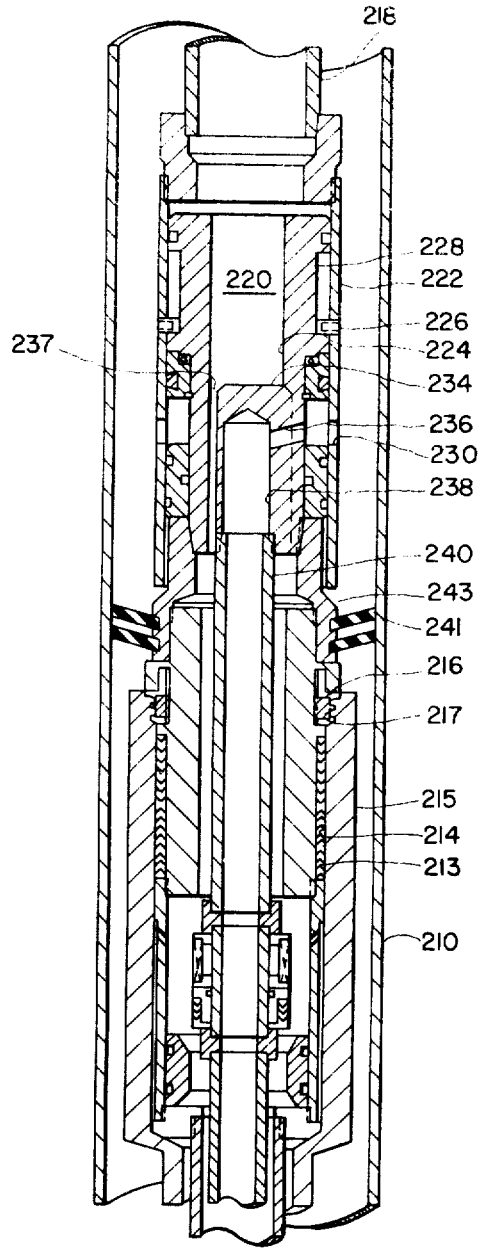

Referring now to FIGS. 6A and 6B, a well bore is illustrated with the well casing 210 in place. A hydraulic set packer 212 is anchored in sealing engagement with the casing 210. A tubing string 218 extends from the surface of the well bore and is in threaded engagement with a crossover valve assembly shown generally at 220. The crossover valve assembly has a housing 222 threadedly engaged to the tubing string 218. A mandrel 224 is disposed in a rotatable and slidable relation to the housing 222. The axial movement and rotation of the housing 222 on mandrel 224 is controlled by jay-pin 226 threadedly engaged with housing 222 and cooperating with jay-slot 228 formed on the outside of mandrel 224 in the same manner as the corresponding parts were described in the preferred embodiment. The crossover valve is illustrated in the open position communicating a port 230 in the housing with passage 236 in the mandrel. A crossover 234 is disposed in sealing engagement with mandrel 224 and having a passage 236 in communication wtih a passage 238. An inner tubing string 240 is connected with passage 238 in crossover 234 and extends to barrier 242 in the lower portion 244 of tubing string 218,. A suitable seal 246 seals the lower end of tubing string 240 to the lower portion 244 of the tubing. A tubular extension 248 is attached to the barrier 242 to extend the passageway and tubing string 240. The lower portion 244 of tubing string 218 has ports 250 above the barrier 242. A tubing string 252 is suspended below packer 212. Ports 254 and tubing string 252 are in communication with ports 250 in the tubing string lower portion 244. A seal bore 256 is provided inside tubing string 252. A seal 258 is provided in sealing engagement with seal bore 256. The casing is perforated with a multiplicity of perforations 270 to communicate with producing zones 272 to allow oil and/or gas or other liquids to flow into the casing 210. Tubing string 252 is provided with a screen pipe 274 with small holes or slots 276. An annulus 278 is provided between the lower tubing string 252 and screen pipe 274 inside casing 210. Particles of rock called gravel 280 which is of a selected screen size to allow passage of oil and gas and other liquids from producing zone 272 through perforations 270 and slots 276 but prevent the flow of sand from the producing zone 272.

A seal bore 214 is provided in tubular extensions 215 above the packer 212. A collet 216 engages threads 217 above seal bore 214 and form a "no left turn latch". A "no left turn latch" has a collet and mating threads which threadedly engage upon axial movement with no rotation and release upon right-hand rotation of collet 216 in left-hand thread 217. Flexible rubber discs 241 are disposed on connection 243 and engage the inside of casing 210 to support sand and prevent settling of sand around the outside of tubular extension 215 and on top of packer 212.

Figure 7:
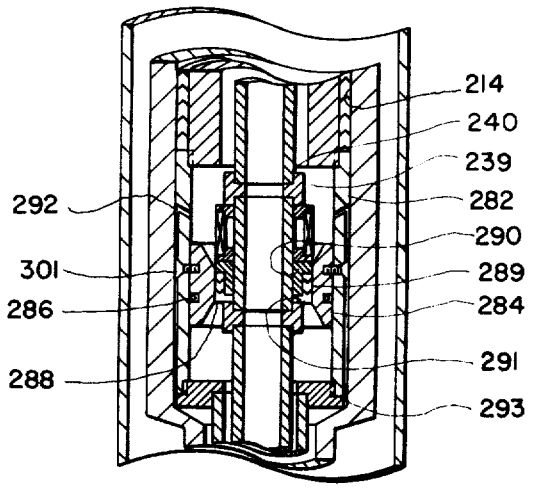
FIG. 7 shows an enlarged portion of the apparatus of FIG. 6 with some parts operably repositioned.

Referring now to FIG. 7, the arrangement for setting the hydraulic packer is described. The hydraulic packer can be of the type generally described in U.S. Patent No. 3,209,831. Tubular extension 215 is illustrated with seal bore 214. Annular passage 239 is formed internally of tubular extension 282 and externally of tubing string 240. Annulus 239 is in communication with tubing string 218 through passageway 237 through crossover valve 220. Sleeve 284 is in sealing engagement with tubular extension 282 with seal 286. Sleeve 284 is sealed to tubing 240 with the seal means or seal sleeve 288 having an external seal 289 in sealing engagement with sleeve 284 and seal ring 290. Seal sleeve 288 is supported against downward movement against shoulder 291 provided on a portion of tubing string 240. Passage 292 communicates annulus 239 to another annulus 293 external of tubular extension 283 and internal of tubular member 215. This annulus is in communication with the inside of packer 212 where application of hydraulic pressure and from tubing 218 will exert a pressure differential from inside packer 212 to the exterior of the packer 212. This pressure differential causes the packer 212 to seal and grip the casing as described briefly hereinafter, but is more fully described in Patent No. 3,209,831.

OPERATION OF THE ALTERNATE EMBODIMENTS

The alternate embodiment shown in FIG. 5 is installed in the well by installing the packer 112 in sealing engagement with the casing 110 at the proper depth, suspending the tubing string 152 so that screen pipe 174 has the slots or holes at approximately the same depth as the perforations 170 in the casing 110. The tubing 148 is suspended on a hanger 149 inside the lower portion 144 of tubing string 118 and is threadedly engaged to the seal nipple 158 and the collet 160. The crossover 134 is threadedly engaged to the lower portion 144 of tubing string 118 which is in turn threadedly connected to seal nipple 116 to the shoulder 181 and the crossover valve 120. This assembly is lowered in the well casing on the tubing string 118 until the seal nipple 116 engages the seal bore 114. The seal nipple 158 engages the seal bore 156 and the shoulder 181 engages the packer 112 to locate the assembly in proper position.

Further operations of the alternate embodiment as shown in FIG. 5 are carried out in the same manner as the operations with the preferred embodiment shown in FIG. 1.

Fluid flow down tubing string 118 goes down through tubing string 140 through passages 138 and 150 and port 154 into the lower annulus 178. Fluid may then flow down the lower annulus to the perforations 170 and the holes or slots 176 in the screen pipe 174. Fluid flow returning to the surface of the well bore can pass inwardly of the screen pipe 174 through holes or slots 176 into the bottom of tubing string 148 up through the tubing string 148 upwardly through the passage 137 and upward inside lower portion 144 of tubing string 118 external of tubing string 140 and through ports 136 and 130 into the annulus above the packer where the fluid may be conducted upwardly to the surface of the well bore. Referring now to FIGS. 6A and 6B, this alternate embodiment utilizes a hydraulic set packer and provides an installation which is completely retrievable. All of the apparatus is assembled and lowered into the well bore on the tubing string 218 until the slots 276 and the screen pipe 274 are substantially at the same depth as casing perforations 270. The hydraulic packer is set by exerting hydraulic pressure inside the tubing string 218. Seal sleeve 284 is in sealing engagement in annular passageway 239 as hereinbefore described. The setting pressure exerted down tubing string 218 is communicating through passage 292 and annular passageway 293 to the interior of the packer 212. This pressure differential causes the packer 212 to seal and grip the casing by causing piston slips 294 to expand to grip the casing 210. Hydraulic cylinder 295 is responsive to the described pressure differential to compress packing elements 296 into sealing engagement with the casing. The downward thrust from a cylinder 295 is supported by slips 297 which are expanded into gripping engagement with the casing 210 by tapered expander 298. Mechanical locking devices 299 and 300 hold the hydraulic packer in set position.

Setting pressure exerted down tubing string 218 to accomplish the setting of hydraulic packer 212 is sealed by seal sleeve 284 which is supported in sealing position by frangible shear screws 301. These frangible parts have a predetermined strength to support a predetermined pressure differential from tubing string 218.

Application of sufficient pressure to shear screws 301 removes support for sleeve 284 in the position shown in FIG. 7 and the pressure causes sleeve 284 to move downwardly to the position shown in FIG. 6A so that communication from annulus 239 is established external of tubing string 240 to ports 250 and 254.

After the hydraulic set packer 212 is anchored in sealing engagement to the well casing 210, the well treating and gravel packing operations can be carried out as hereinbefore described using the crossover valve 220. After gravel 280 has been placed in the annulus 278, the tubing string 218 and crossover valve assembly 220 and seal nipple 213 can be released from the tubular extension 215 and seal bore 214 to permit retrieval of the tubing string 218, crossover valve 220 and the associated equipment leaving the packer 212, the lower tubing string 252 and the screen pipe 274 in place.

If it is desired to retrieve the packer 212 and the remainder of the equipment in the well, the gravel can be circulated back in a reverse manner from the method by which it was positioned by opening crossover valve 220 and pmping fluid down the upper casing annulus above the packer to enter housing port 230, through crossover passage 236 and down tubing string 240, out the screen pipe slots 276 to pick up the gravel 280 and return it up through ports 254 and 250, up through the annulus external to tubing string 244 and passage 237, and upward through tubing string 218 to the surface of the well bore. After a substantial portion of the gravel has been removed, the entire apparatus may be retrieved by lifting upwardly with tubing string 218 to release the hydraulic packer 212 from the sealing engagement with the well casing in a manner more fully described in Patent No. 3,209,831. The packer 212 may be released from the well casing and the entire apparatus may be retrieved.

It should thus be appreciated that there has been described and illustrated herein the preferred embodiments of the invention. However, various modifications of these embodiments will occur to those skilled in the art. For example, the invention contemplates that those skilled in the art may desire to first acidize or otherwise treat the well and then gravel pack the formation of interest. The invention also contemplates the gravel packing of the formation and then the further treatment of the well. Likewise, the invention contemplates that the gravel packing material may be recovered from the well at any time so desired.

The embodiments of the invention in which an exclusive property or privilege is claimed are defined as follows:

1. A crossover valve apparatus adapted for use in a well bore having a first tubing string and a second tubing string inside a portion of the first tubing string comprising:

a housing operably connectable to the first tubing string and having a pair of axially spaced apart seal bores and at least one lateral opening in the wall of said housing located intermediate said seal bores; and, a mandrel operably connectable to the first tubing string, within said housing, said mandrel being movable axially between a first position and a second position relative to said housing and having a first seal engaging one of said seal bores in both of said positions, a second seal spaced axially from said first seal and engaging one of said seal bores in said first position and engaging the other said seal bore in said second position, at least one side port in the wall of said mandrel located between said first and second seals, a crossover defining a first passage communicating said at least one side port and the second tubing string and a second passage communicating said mandrel above said crossover and said mandrel below said crossover, and releasable means for locking said mandrel and said housing in one of said first or second positions and for allowing said mandrel and said housing to move the other of said first or second positions, wherein said releasable means comprises a jay-slot and a cooperating jay-pin.

* * * * *